United States Patent [19]

Kuperman

[11] Patent Number: 4,911,263

[45] Date of Patent: Mar. 27, 1990

[54] AMBULATORY LADDER

[76] Inventor: Aryeh Kuperman, 15/3 Havradim St., Givat Amos, Haifa, Israel, 20306

[21] Appl. No.: 387,799

[22] Filed: Aug. 1, 1989

[51] Int. Cl.[4] ..... E06C 1/397

[52] U.S. Cl. ..... 182/13; 182/16

[58] Field of Search ..... 182/12, 13, 14, 15, 182/16, 17, 127

[56] References Cited

U.S. PATENT DOCUMENTS

| | | | |
|---|---|---|---|
| 808,252 | 12/1905 | Padon | 182/13 |
| 1,306,546 | 6/1919 | Keeper | 182/13 |
| 2,362,170 | 11/1944 | Swaisgood | 182/17 |
| 2,380,160 | 7/1945 | Fieroh | 182/13 |
| 2,775,488 | 12/1956 | Wingrove | 182/13 |
| 2,845,208 | 7/1958 | Antonietti | 182/13 |
| 3,722,766 | 3/1973 | Barrineau | 224/324 |
| 3,727,720 | 4/1973 | Duc | 182/127 |
| 3,800,912 | 4/1974 | Ashworth | 182/127 |
| 4,174,021 | 11/1979 | Barlock | 182/127 |

*Primary Examiner*—Reinaldo P. MacHado
*Attorney, Agent, or Firm*—Edward Langer

[57] ABSTRACT

Ambulatory ladder apparatus constructed as a stepladder frame supported on a set of four base wheels. A user-powered drive is mounted under the lowermost step of the ladder, and is mechanically connected with a pair of the base wheels. A drive arm extending from the drive is accessible to a user while aboard the stepladder. By pumping action of the drive arm, the user-powered drive causes rotation of the base wheels, moving the ladder forward. A steering mechanism provided on the drive arm allows the user to direct the motion of the ladder during the pumping action. Thus, without requiring the user to dismount, the ladder may be easily repositioned by operation of the drive, allowing greater work efficiency in many repair, remodeling, painting and construction projects, by eliminating the additional time normally required for dismounting and repositioning the ladder.

20 Claims, 4 Drawing Sheets

AMBULATORY LADDER

FIELD OF THE INVENTION

The present invention relates to ladder constructions, and more particularly, to a novel wheeled ladder construction provided with a user-powered drive which is operable while aboard the ladder, allowing it to be easily repositioned during use.

BACKGROUND OF THE INVENTION

Movable ladder constructions are known in prior art, in such applications such as fire engine trucks, utility trucks, airline passenger staircases, and other vehicle-mounted types. U.S. Pat. No. 3,722,766 describes a truck-mounted ladder rack to hold an extension ladder on a telephone truck. U.S. Pat. No. 3,727,720 describes ladders for use in picking fruit which are slidably mounted on a supporting vehicle. U.S. Pat. No. 3,800,912 describes access equipment having a movable boom structure to which ladders are attached, all mounted on a supporting structure such as a vehicle.

A ladder truck for use in stores for transporting goods to display shelves is described in U.S. Pat. No. 4,174,021. A wheeled truck is disclosed to which a stepladder is attached at one end in pivotal fashion. When the stepladder is raised, the ladder truck can be wheeled around between positions before the stepladder is once again lowered.

The typical folded ladder construction used in repairing, painting, and remodeling work must be repositioned as the work progresses. Repositioning the ladder is a burdensome task which increases the time required to complete the work by 20%–25% of the time otherwise needed. For small stepladders, the vehicle arrangements described in the prior art are not practical, since the cost of such designs is prohibitive.

Therefore, it would be desirable to provide a ladder construction which reduces the time required for repositioning by allowing manual movement without requiring the user to dismount from the ladder in each instance.

SUMMARY OF THE INVENTION

Accordingly, it is a principal object of the invention to overcome the above-mentioned disadvantages of the prior art and to provide a novel stepladder construction capable of being repositioned by operation of a user-powered drive. The user-powered drive is operable aboard the stepladder, reducing the time required for repositioning between locations.

In accordance with a preferred embodiment of the present invention, there is provided ambulatory ladder apparatus comprising:

a plurality of base wheels;

a ladder structure supported by said base wheels;

user-powered drive means comprising a drive arm and drive shaft supported by said ladder structure, said drive shaft being mechanically connected for driving rotation of a pair of said base wheels for moving the ladder in accordance with a pumping action of said drive arm as provided by a user while aboard the ladder, a steering mechanism mounted on said drive arm being operable with another pair of said base wheels to control the direction of travel of the ladder during said pumping action.

In the preferred embodiment, the ambulatory ladder apparatus is constructed as a stepladder frame supported on a set of four base wheels. A user-powered drive is mounted under the lowermost step of the ladder, and is mechanically connected with a pair of the base wheels. A drive arm extending from the user-powered drive is accessible to a user while aboard the stepladder. By pumping action of the drive arm, the drive transmits rotational power to the base wheels, moving the ladder forward. A steering mechanism provided on the drive arm allows the user to direct the motion of the ladder during the pumping action. Thus, without requiring the user to dismount, the ladder may be easily repositioned by operation of the user-powered drive.

The user-powered drive comprises a crankshaft connected via linkages to the corners of a wedge eccentrically mounted on a drive shaft which rotates in relation to the pumping action provided to the drive arm. A brake mechanism is provided to lock the base wheels, preventing continued rotation once the ladder has been repositioned. The steering mechanism is provided as a set of cables connecting a pistol-grip handle on the drive arm with the steering wheels such that rotation of the pistol-grip handle directs the steering wheels by movement of the cables.

The ladder is designed for lightweight construction, and may be folded and stored when not in use. By virtue of its novel design, a simple, durable, practical and low-cost ladder may be constructed for use in many applications. By use of the user-powered drive, greater work efficiency may be achieved in many repair, remodeling, painting and construction projects, since the additional time normally required for dismounting and repositioning the ladder between work locations is eliminated.

Other features and advantages of the invention will become apparent from the drawings and the description contained herein below.

BRIEF DESCRIPTION OF THE DRAWINGS

For a better understanding of the invention with regard to the embodiments thereof, reference is made to the accompanying drawings in which like numerals designate corresponding elements or sections throughout, and in which.

DETAILED DESCRIPTION OF A PREFERRED EMBODIMENT

Figure 1:
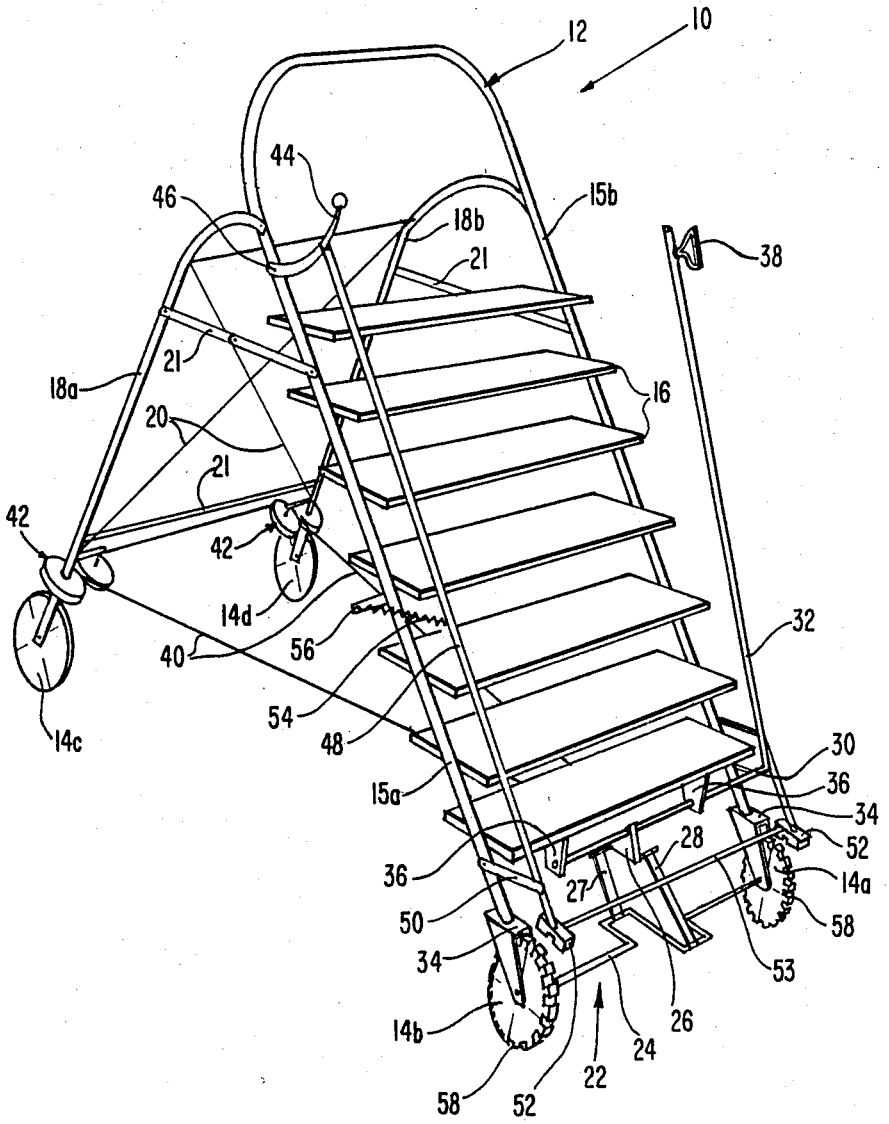
FIG. 1 is an overall perspective view of a preferred embodiment of an ambulatory ladder apparatus constructed and operated in accordance with the principles of the present invention.

Referring now to FIG. 1, there is shown an overall perspective view of a preferred embodiment of an ambulatory ladder apparatus 10 constructed and operated in accordance with the principles of the present invention. Ladder 10 comprises a stepladder frame 12 supported on a set of base wheels 14*a–d*, with frame 12 having mounted on the front legs 15*a–b* thereof a plurality of steps 16. The rear legs 18*a–b* of frame 12 are stabilized by a set of support cables 20 and braces 21 arranged as shown.

In accordance with the principles of the present invention, ladder 10 is provided with a use-powered drive 22 comprising a crankshaft 24 to which drive wheels 14*a–b* are mounted at either end, a wedge-shaped member 26, and a set of linkages, 27, 28 interconnecting them. Wedge-shaped member 26 is mounted at one corner thereof so as to rotate with a drive shaft 30, which is integrally formed with a drive arm 32. Drive shaft 30 is hollow and is supported above wheel housings 34 in pivoting fashion on be rings mounted on a pair of support legs 36, attached to the underside of lowermost step 16. As will be further described herein, drive 22 is operable by a user-furnished pumping action of arm 32, causing crankshaft 24 and drive wheels 14*a–b* to rotate, and enabling ladder 10 to be repositioned while the user remains aboard steps 16.

A pistol-grip handle 38 is mounted so as to pivot at one end of arm 32. As best shown in FIG. 4, pistol-grip handle 38 is connected via steering cables 40 to steering assemblies 42, which operate with steering wheels 14*c–d*. Thus, while providing pumping action to arm 32, the user can also steer ladder 10 in the desired direction of travel.

A handbrake mechanism comprises a pivoting lever 44, which is mounted to leg 15*a* of frame 12 at pin 46, and is connected with a movable rod 48 which extends downward towards drive wheel 14*b*. Movable rod 48 is supported at its lower end by a pivotable guide arm 50, and has attached to its lower end a brake shoe 52. Another brake shoe 52 is similarly arranged on leg 15*b* of frame 12, with a crossbar 53 interconnecting brake shoes 52. A tension spring 54 extending between movable rod 48 and a support pin 56 maintains movable rod 48 in one of two operating positions: a release position in which brake shoes 52 are raised, and an engaged position in which brake shoes 52 engage teeth 58 provided in drive wheels 14*a–b*. Thus, by depressing or raising brake lever 44, brake shoes 52 can be used to lock drive wheels 14*a–b* in position, once ladder 10 has been repositioned. Brake lever 44 may be replaced by a brake pedal.

Figure 3:
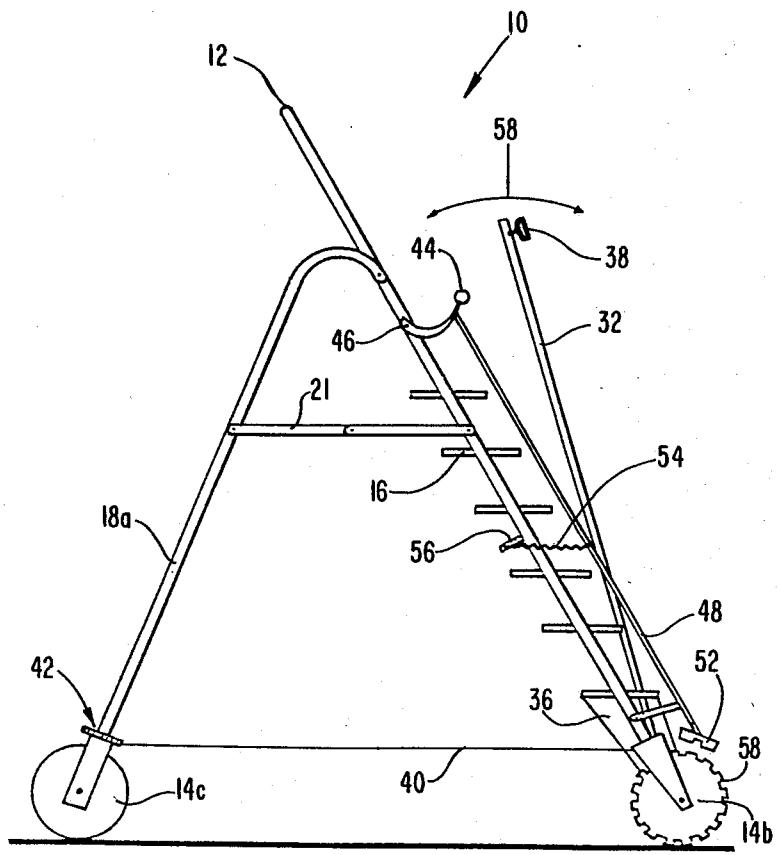
FIGS. 2–3 are, respectively, front and side views of the ladder shown in FIG. 1.
Figure 2:
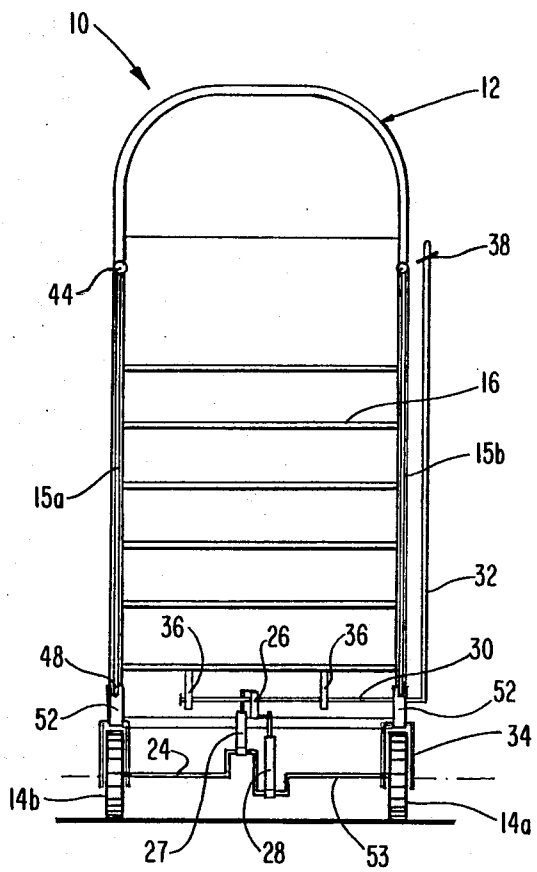

Referring now to FIGS. 2–3, there are shown, respectively, front and side views revealing further construction details of the preferred embodiment of ambulatory ladder 10. In operation, while the user is aboard steps 16, he has access to drive arm 32 along its length and can provide it with pumping action as indicated by arrow 58. This motion is transferred to drive wheels 14*a–b* via drive 22, as described further with reference to FIG. 4. In this fashion, ladder 10 is movable forward or backward as desired, easing the task of repositioning ladder 10, and thereby contributing to increased work efficiency and smoother work progress in many applications.

Figure 4C:
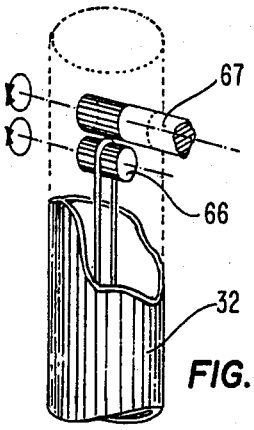
FIGS. 4*a–c* are respectively, overall perspective and detailed views of a user-powered drive for moving the ladder of FIGS. 1–3.
Figure 4B:
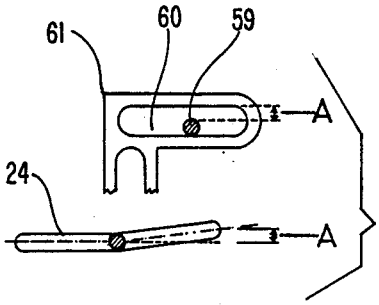
Figure 4A:
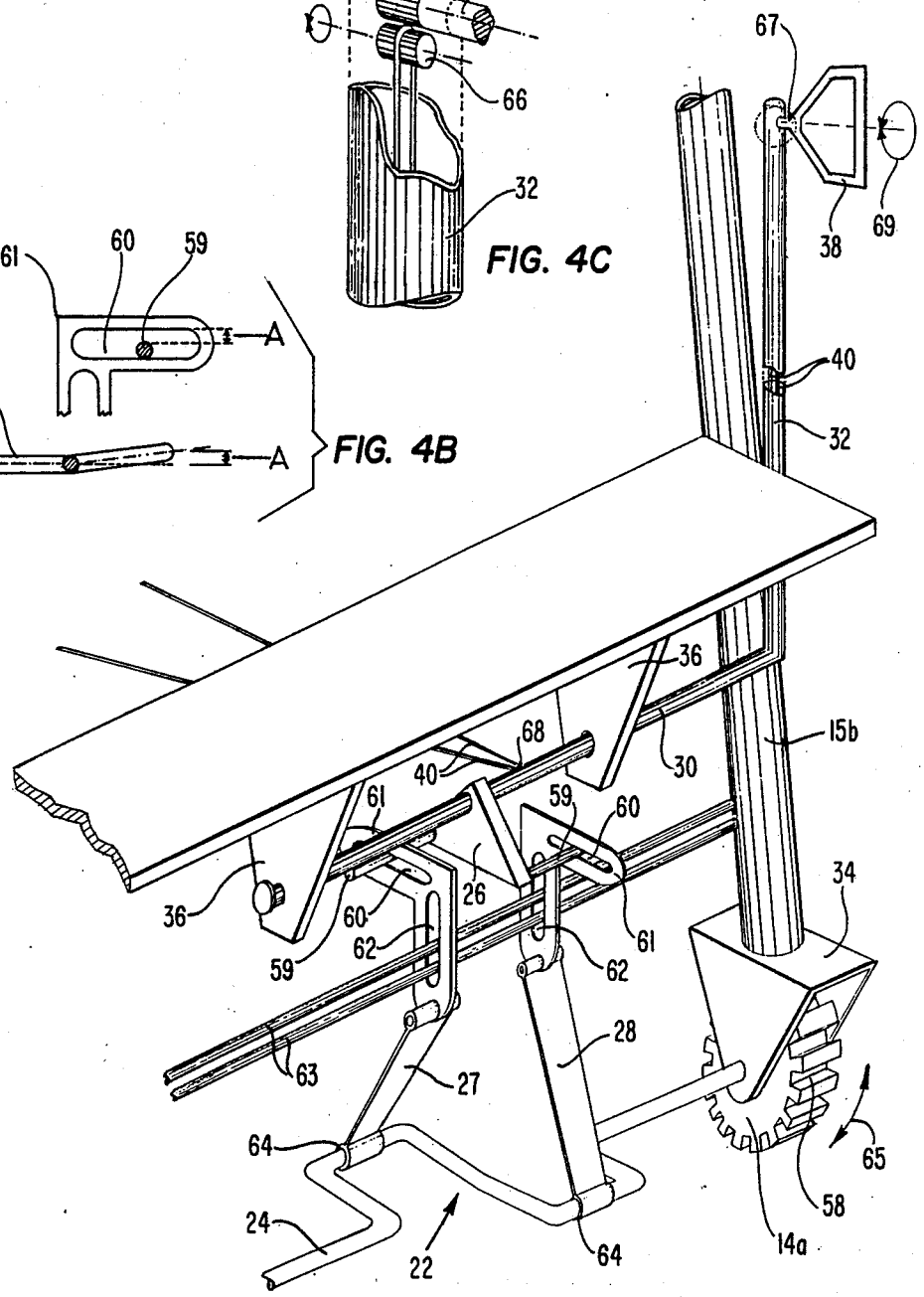

Referring now to FIGS. 4*a–c*, there are shown, respectively, overall perspective and detailed views of the user-powered drive 22 for mechanically rotating drive wheels 14*a–b*. As shown, each of the lower two corners of wedge-shaped member 26 has fixedly mounted thereto a laterally extending pin 59. Each of pins 59 extends through a slot 60 formed in a horizontal leg of an L-shaped linkage 61. Passing through slot 62 in the vertical leg of linkage 61 are a pair of guide bars 63 extending between legs 15*a–b*. Each of linkages 61 serves as a pivoting attachment point for an end of respective linkages 27 and 28, the other end being pivotably connected to crankshaft 24 at points 64.

As described previously, drive arm 32 may be pumped, causing drive shaft 30 to rotate wedge-shaped member 26 up and down. Pumping action of arm 32 causes pins 59 of member 26 to move up and down in reciprocating fashion, alternately lifting and lowering L-shaped linkages 61, which slide along slots 62 relative to guide bars 63. This motion is transferred via linkages 27 and 28 to crankshaft 24, which rotates in a direction initially determined by the starting direction of arm 32 pumping motion. Therefore, if arm 32 is first pushed forward, the far corner of member 26 will move downward, and the near end will move upward, causing crankshaft 24 and drive wheels 14*a–b* to rotate in the forward direction as defined by arrow 65.

As will be appreciated by those skilled in the mechanical design arts, when points 64 of crankshaft 24 are aligned one above the other, a "dead" spot is normally encountered. To overcome this problem, a slight bend is provided in the segments of crankshaft 24 (side view FIG. 4*b*). Each segment can be considered as lying in a plane, with the planes rotationally offset from one another by an offset dimension "A", such that the plane of strut linkage connection points 64 does not pass through the central axis of crankshaft 24. Offset dimension "A" is also provided as a gap between pins 59 in slots 60 of L-shaped linkages 61, to allow the necessary free play for smooth operation. In this fashion, the "dead" spot in crankshaft 24 rotation is eliminated.

In FIG. 4*c*, a partial cutaway view of arm 32 is shown, revealing a hollow construction in which steering cables 40 are contained. Steering cables 40 are looped around a pin 66 which is frictionally engaged with a shaft 67 of pistol-grip handle 38, so that they rotate in opposite directions. The lengths of cables 40 extend within arm 32 and drive shaft 30 to an exit 68, from which they run to steering assemblies 42 (FIG. 1). Turning of pistol-grip handle 38 in a direction as indicated by arrows 69 causes movement of steering cables 40, which is transferred to steering assemblies 42.

Figure 5:
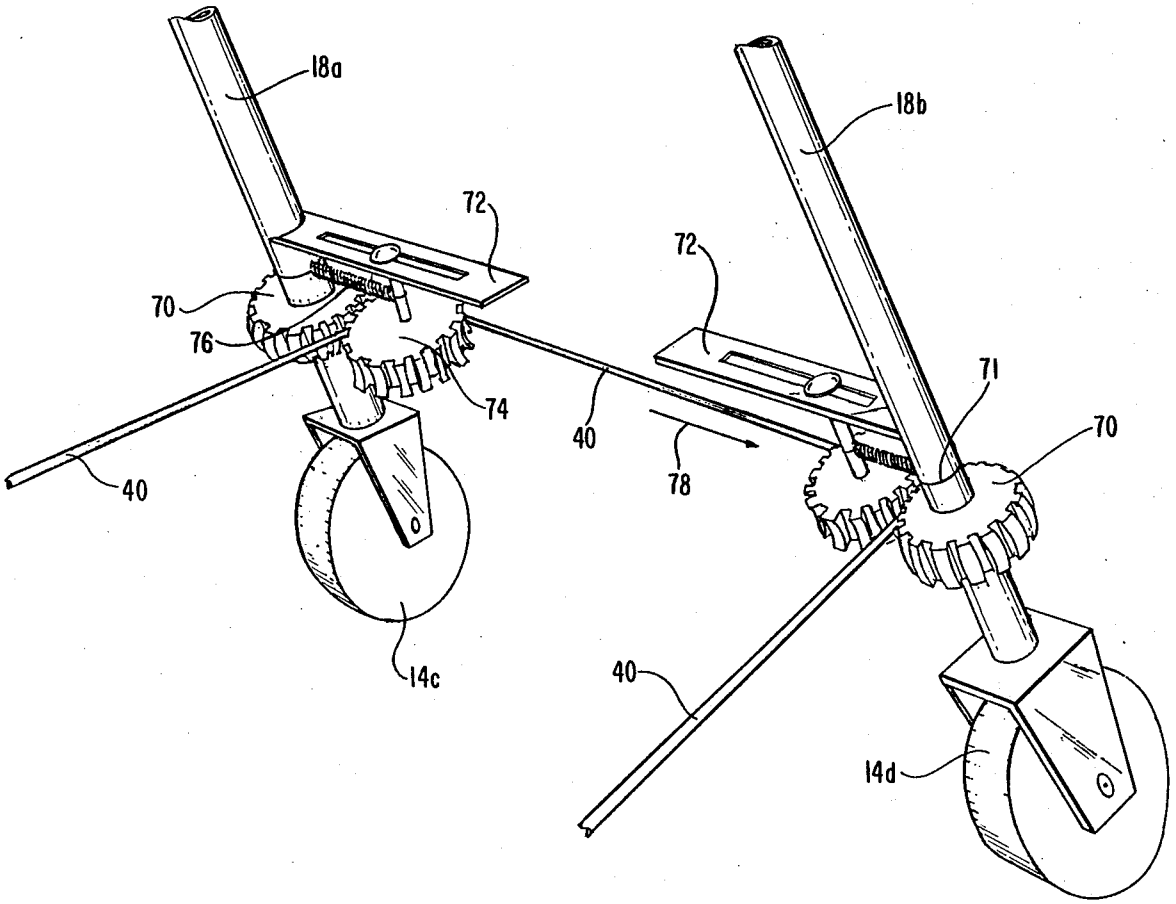
FIG. 5 is a perspective view of a pair of steering wheels operable with the user-powered drive of FIGS. 4*a–c*.

Referring now to FIG. 5, a perspective view of steering assemblies 42 is shown. Each of rear legs 18*a–b* of frame 12 has mounted thereon a toothed wheel 70 which can be rotated at a swivel joint 71 to turn a respective one of steering wheels 14*c–d*. A slotted flange 72 extending from each of rear legs 18*a–b* supports a pin-mounted toothed wheel 74 which engages the teeth of toothed wheel 70 by virtue of spring tension provided by spring 76. Steering cable 40 passes between toothed wheels 70 and 74, allowing the teeth to become engaged while insuring contact. Toothed wheels 70 and 74 may be manufactured of hard plastic, cable 40 made of a strong, resilient material.

As pistol-grip handle 38 is rotated, movement of steering cable 40 will impart rotational motion to steering assembly 42 via toothed wheels 70 and 74. Thus, motion of steering cable 40 to the right as indicated by arrow 78 will cause steering assemblies 42 to turn wheels 14*c–d* in the right-handed direction of travel. By combining pistol-grip handle 38 with arm 32, the user may effect a pumping action for moving ladder 10 forward while allowing ladder 10 to be steered in the direction of travel.

It will be appreciated by those skilled in the art that many variations are possible in the mechanical design of user-powered drive 22 and the steering and brake mechanisms. The preferred embodiment of ladder 10 is presented as one which achieves the goal of a simple, functional and durable construction, and which is easy to reposition because of the combined drive and steering mechanisms.

In an alternative design, drive 22 may be modified such that drive arm 32 is operated by a pedal formed as part of one of steps 16, or a series of interconnected pedals on a plurality of steps 16 may be provided. Thus, pumping action may be supplied by repeated foot depression, making for convenient operation.

Having described the invention with regard to certain specific embodiments thereof, it is to be understood that the description is not meant as a limitation since further modifications may now suggest themselves to those skilled in the art, and it is intended to cover such modifications as fall within the scope of the appended claims.

I claim:

1. Ambulatory ladder apparatus comprising:

a plurality of base wheels;

a ladder structure supported by said base wheels;

user-powered drive means comprising a drive arm and drive shaft supported by said ladder structure, said drive shaft being mechanically connected for driving rotation of a pair of said base wheels for moving the ladder in accordance with a pumping action of said drive arm provided by a user while aboard the ladder, a steering mechanism mounted on said drive arm being operable with another pair of said base wheels to control the direction of travel of the ladder during said pumping action.

2. The apparatus of claim 1 wherein said ladder structure comprises a stepladder frame having front and rear legs supported respectively on said base wheels including a pair of drive wheels and a pair of steering wheels, said drive shaft driving said drive wheels via a crankshaft connected between them.

3. The apparatus of claim 2 wherein said stepladder frame is foldable.

4. The apparatus of claim 2 wherein said drive shaft is mechanically connected to said crankshaft via a pair of L-shaped and strut linkages, said drive shaft having a wedge-shaped member fixedly mounted thereon at its upper corner, the lower two corners of said member each having a pin extending laterally therefrom, said pins extending in opposite directions, each pin passing through a slot formed in a horizontal leg of a respective one of said L-shaped linkages, a vertical leg thereof having its lower end pivotably attached to an upper end of each of said strut linkages, the lower ends thereof being pivotably connected to said crankshaft, each of said L-shaped linkages being horizontally stabilized by horizontal guide bars passing through a slot formed in said vertical leg thereof, such that said drive arm pumping action alternately raises and lowers said pins and said L-shaped linkages in reciprocating fashion, causing said strut linkages to transfer rotation motion to said crankshaft.

5. The apparatus of claim 4 wherein said horizontal guide bars extend between said stepladder frame front legs.

6. The apparatus of claim 4 wherein said strut linkages have their lower ends connected to said crankshaft at points radially spaced from a central axis thereof on oppositely directed crankshaft segments, each of said segments lying in a plane, said planes being rotationally offset from one another by a predetermined offset dimension, such that a plane defined by said strut linkage connection points does not pass through said crankshaft central axis.

7. The apparatus of claim 6 wherein said slot of said horizontal L-shaped leg is provided with said offset dimension between said pin and an edge thereof to allow for free play.

8. The apparatus of claim 2 wherein said drive arm is hollow and said steering mechanism comprises a pistol-grip handle pivotably mounted to said drive arm at one end thereof, a set of steering cables contained in said drive arm being looped at one end about said pistol-grip handle and at the other end about a pair of steering assemblies each mounted on a respective one of said steering wheels, pivoting of said pistol-grip handle directing said steering assemblies in accordance with the movement of said steering cables.

9. The apparatus of claim 8 wherein each of said steering assemblies comprises a pair of toothed wheels, one mounted on said steering wheel and another supported by said stepladder frame, said steering cables passing between said toothed wheels which engage one another while maintaining contact with said steering cables, such that movement of said steering cables determines the direction of travel by turning said steering wheel.

10. The apparatus of claim 8 wherein said drive arm is pedal-operated by foot depression of a pedal formed as a portion of a ladder step.

11. The apparatus of claim 1 wherein at least one of said base wheels has a toothed outer circumferential contour and said ladder structure supports a brake lever, a toothed brake shoe mounted at an end of said brake lever being lowerable for engaging and locking said toothed base wheel in position.

12. The apparatus of claim 11 wherein said brake lever is pedal-operated by foot depression of a pedal formed as a portion of a ladder step.

13. A method of moving a ladder structure supported by a set of base wheels and having a drive arm and drive shaft mechanically connected for driving rotation of at least a pair of the base wheels, said method comprising the steps of:

pumping said drive arm to provide reciprocating motion of said drive shaft while aboard the ladder; and steering another pair of said base wheels with a drive arm-mounted steering mechanism during said pumping step to control the direction of ladder travel.

14. The method of claim 13 wherein the initial direction of pumping said drive arm controls said ladder direction of travel.

15. A user-powered drive apparatus mounted on a structure and arranged to move it while the user is aboard the structure, said drive apparatus comprising:

a crankshaft connected between a pair of drive wheels supporting the structure; and drive arm and drive shaft means mechanically connected to said crankshaft via a pair of L-shaped and strut linkages, said drive shaft having a wedge-shaped member fixedly mounted thereon at its upper corner, the lower two corners of said member each having a pin extending laterally therefrom, said pins extending in opposite directions, each pin passing through a slot formed in a horizontal leg of a respective one of said L-shaped linkages, a vertical leg thereof having its lower end pivotably attached to at upper end of each of said strut linkages, the lower ends thereof being pivotably connected to said crankshaft, each of said L-shaped linkages being horizontally stabilized by horizontal guide bars passing through a slot formed in said vertical leg thereof, such that said drive arm pumping action alternately raises and lowers said pins and said L-shaped linkages in reciprocating fashion, causing said strut linkages to transfer rotation motion to said crankshaft.

16. The apparatus of claim 15 wherein said strut linkages have their lower ends connected to said crankshaft at points radially spaced from a central axis thereof on oppositely directed crankshaft segments, each of said segments lying in a plane, said planes being rotationally offset from one another by a predetermined offset dimension, such that a plane defined by said strut linkage connection points does not pass through said crankshaft central axis.

17. The apparatus of claim 16 wherein said slot of said horizontal L-shaped leg is provided with said offset dimension between said pin and an edge thereof to allow for free play.

18. The apparatus of claim 15 further comprising a pair of steering wheels and a steering mechanism therefor mounted on said drive arm and being operable to control the direction of travel of the ladder during said pumping action, said steering mechanism comprising a pistol-grip handle pivotably mounted to said drive arm at one end thereof, a set of steering cables contained in a hollow interior of said drive arm being looped at one end about said pistol-grip handle and at the other end about a pair of steering assemblies each mounted on a respective one of said steering wheels, pivoting of said pistol-grip handle causing turning of said steering assemblies in accordance with the movement of said steering cables.

19. The apparatus of claim 18 wherein each of said steering assemblies comprises a pair of toothed wheels, one mounted on said steering wheel and another supported by the structure, said steering cables passing between said toothed wheels which engage one another while maintaining contact with said steering cables, such that movement of said steering cables determines the direction of travel by turning said steering wheel.

20. The apparatus of claim 15 wherein at least one of said drive wheels has a toothed outer circumferential contour and the structure supports a brake lever, a toothed brake shoe mounted at an end of said brake lever being lowerable for engaging and locking said toothed drive wheel in position.

* * * * *